United States Patent [19]

Schomerus

[11] 4,301,207

[45] Nov. 17, 1981

[54] FLOOR COVERING FOR INDOOR SPORTS ARENA

[76] Inventor: Cristoph Schomerus, Marksweg 22, 4600 Dortmund, Fed. Rep. of Germany

[21] Appl. No.: 121,663

[22] Filed: Feb. 15, 1980

[30] Foreign Application Priority Data

Feb. 19, 1979 [DE] Fed. Rep. of Germany ..... 2906274

[51] Int. Cl.[3] ..... B32B 5/16

[52] U.S. Cl. ..... 428/241; 273/1.5 R; 273/29 R; 273/31; 428/244; 428/247; 428/255; 428/283; 428/286

[58] Field of Search ..... 428/241, 244, 247, 255, 428/283, 286, 331, 117, 150; 273/1.5 R, 29 R, 31

[56] References Cited

U.S. PATENT DOCUMENTS 2,210,348 8/1940 Swope ..... 428/241

4,146,635 3/1979 Eigenmann ..... 428/283

*Primary Examiner*—Marion McCamish

*Attorney, Agent, or Firm*—Karl F. Ross

[57] ABSTRACT

An indoor sports arena of the type having a massive floor structure, e.g. for tennis, track and other athletic events requiring a cushioned tread by the player or sportsman, comprises a resilient underlayment of open work structure which can be bonded to the surface and is underlain by a packed particulate material usually of a sand, red sand, cinders or another composition commonly used for outdoor track and sport fields. The open work can consist of a nonwoven mat of fibers, a screen, or other cellular open work layer of natural or synthetic fibers which can be bonded by an elastic adhesive to the underlying surface. Excellent results are obtained with an underlayment of coconut fiber.

5 Claims, 4 Drawing Figures

FLOOR COVERING FOR INDOOR SPORTS ARENA

FIELD OF THE INVENTION

My present invention relates to floor covering compositions for sports arenas and, more particularly, to a floor covering for use in sports arenas for tennis and like activities requiring a reasonably active surface for rebounding of a ball and for a cushioned, shock-absorbing tread of the player or sportsman.

Background of the Invention

Sports arenas have been provided heretofore with wood inlaid flooring, i.e. a parquet, generally coated with a hard wax or treated with a synthetic resin lacquer, e.g. a polyurethane, to provide an effective rebounding surface, a reasonably resilient tread for the player or sportsman and a shock-absorbing characteristic which prevents dangerous forces from being transmitted to the joints of the player or another participant in some athletic event.

Since such floors are expensive, require considerable maintenance and are readily damaged by extremely active sports, it has been proposed to provide heretofore linoleum or synthetic resin floor coverings and even carpetry designed to withstand the rigors of the athletic activity. All of these floor coverings are applied to a finished floor on top of a subfloor, generally cast from concrete, asphalt or bituminous materials and flooring plasters.

Inlaid-wood flooring is generally supported above the massive subflooring by spacers so as to provide a greater degree of yieldability and the other floor coverings mentioned generally are disposed on top of cushioned layers.

Sports arenas with such massive (cast) subfloors generally cannot accommodate directly materials used to cover outdoor sports areas with a similar effect. For example, the use of cinder layers for tracks and athletic areas, of "dirt" playing fields, of clay, of sand or red sand, and the like, in indoor arenas has been precluded heretofore by the tendency of the materials to migrate, the inability to pack them effectively and, generally, the tendency of bare spots to form at the most heavily trafficked regions of an indoor arena.

This is not to say that such materials are not desirable as indoor floor coverings, since it is well known that certain sports, for example tennis, suffer when it is necessary to play upon artificial turf, (carpetry) wood, linoleum and the like.

Thus, while it has long been recognized that a particulate composition surface of cinders or "dirt" is desirable for indoor tennis as well as outdoor tennis, there has been no practical solution to the problem of migration, the care which must be provided (e.g. rolling, sprinkling, etc.).

Attempts were made to solve this problem by erecting upon the subsurface of a cast material, as mentioned previously, formations designed to stabilize the granular or particulate covering. The mounting of such formations is a time-consuming and expensive proposition and has not heretofore been found to be fully satisfactory, especially because the exposure of these formations during use may interfere with the athletic activity.

OBJECTS OF THE INVENTION

It is therefore the principal object of my present invention to provide an improved floor covering for an indoor sporting arena whereby the disadvantages of these earlier systems can be obviated.

Another object of the invention is to provide a low cost floor covering for a sporting arena which does not create problems when migration occurs and which can be handled and maintained in a manner similar to that used for tending similar surfaces in outdoor sporting facilities.

Yet another object of the invention is to provide an improved method of covering the floor of an indoor sporting arena.

SUMMARY OF THE INVENTION

These objects and others which will become more readily apparent hereinafter are attained, in accordance with the present invention, by applying to the massive subfloor of an indoor sporting arena a layer of an open work forming a support and bonding layer and onto which a layer of sand, red sand, cinders or particulate playing-surface material is deposited so that this layer partially penetrates into the bonding layer. According to the invention, therefore, the bonding and retention layer of elongated strands, namely, fibers, wires or filaments, is secured directly on the poured concrete, asphalt or flooring plaster subsurface and the particulate material, which can be of the type used in forming dirt tracks in outdoor applications, is applied and packed into the first layer so as to be retained and stabilized thereby.

The resulting surface has been found to be particularly effective for active sports such as tennis, affording excellent playability and rebounding characteristics and indeed providing a surface which reacts similarly to outdoor tennis courts. Surprisingly, even though the thickness of the open work underlayment may be less than half the total thickness of the floor covering material, undulations and wave formations in the packed material seldom, if ever, arise. In addition, for reasons which are not completely clear, the underlayment improves the elasticity or yield of the floor covering by comparison to the yield when the particulate layer is applied directly to the massive surface, i.e. when the underlayment is omitted.

The invention for the first time offers the possibility of providing indoor athletic surfaces which in all respects are equivalent to outdoor surfaces and apart from the underlayment can be composed of the same materials.

For the underlayment, I prefer to make use of an elastic material with an open work or grate-like or reticulate structure, since the particulate material readily penetrates such an open work and is locked therein upon packing so that an especially homogeneous elastic floor covering is provided. Coconut fiber mats, in particular, have been found to be optimum as to elasticity, retention of the particulate mass, wear resistance, resistance to moisture, etc.

While coconut fiber mats represent the best mode currently known to me for carrying out the invention in practice, I have found that synthetic resin fiber, woven and nonwoven fabrics, metal screening and metal fabric are also effective.

Advantageously, the average opening size of the underlayment should be selected in accordance with the average particle size of the filling and packing mass, e.g. the particle size of the material which is applied to the mat can correspond to the mesh size of the mat, thereby ensuring an optimum interaction of the particulate material and the mat.

Obviously, the support and retention layer should be fixed to the subsurface and it is thus a feature of the invention to attach the retention layer by a spaced-apart means in the form of nails, staples, anchors or the like, or the tensioning of the retention layer along the edges of the subsurface, e.g. to the vertical walls thereof. Best results are achieved, however, when, as the sole fixing means or in combination with the other fixing alternatives mentioned, the retention layer is coated with an adhesive and is bonded thereby to the subsurface.

When the adhesive is an elastic or elastomeric material, it provides the dual functions of attaching the support and retention layer and increasing the tread elasticity of the composite flooring.

The use of the adhesive also affords the possibility that the precoated retention layer can be rolled and stored in a hermetically sealed container at the factory for delivery to the sports arena at which it is to be laid down. The air-tight seal prevents activation of the adhesive which, advantageously, is of the air activation type, i.e. bonds upon exposure to air. When the retention layer is coiled for storage, transportation or delivery, advantageously a strippable or masking sheet can be provided to prevent migration of the adhesive or bonding of the adhesive-coated surface to the upper surface of successive turns. The masking layer also permits the coil to be unrolled without difficulty.

The flooring of the present invention can and, indeed, must be treated, maintained and prepared in the same manner as exterior surfacing materials of the same type. For example, when the cinder or dirt composition is applied to the retention layer, it must be rolled or similarly packed. To prevent dust formation during the packing and also during eventual use, a fine spray of water can be applied to the layer. The subflooring may be drainage-free, in which case application of the moisture or mist should be controlled to ensure that the flooring is not saturated or wet through. However, according to another feature of the invention, the subflooring is provided with drainage so that a thorough wetting of the composition is possible.

BRIEF DESCRIPTION OF THE DRAWING

The above and other features, objects and advantages of the present invention will become more readily apparent from the following description, reference being made to the accompanying drawing in which.

SPECIFIC DESCRIPTION

Figure 1:
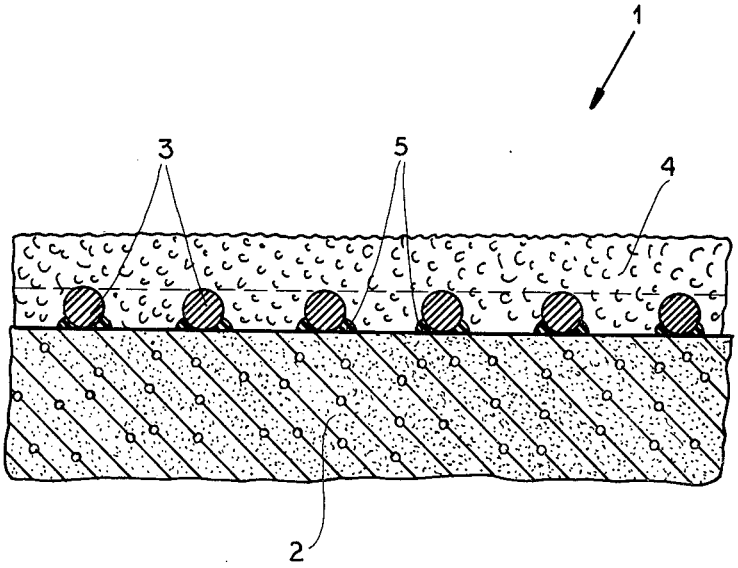
FIG. 1 is a diagrammatic cross-sectional view illustrating the flooring for an indoor sports arena according to the invention.

As will be apparent from FIG. 1, a support and retention layer 3 is applied to a massive subflooring or subsurface 2, e.g. of concrete, and consists of an elastic material with a reticulate configuration, e.g. coconut fiber which has been illustrated as having discrete uniformly spaced-apart filaments. In general, however, this fabric will be a nonwoven mesh or mat into which the solid particles of the filler or packing can penetrate with an average dimension of its interstices corresponding to the average particle size of the packing material.

In the illustrated embodiment, the packing material is represented at 4 and consists of sand, red sand, cinders, dirt or the like, commonly used for outdoor sports field surfacing. An elastic adhesive 5 bonds the layer 3 to the subsurface 2.

Figure 3:
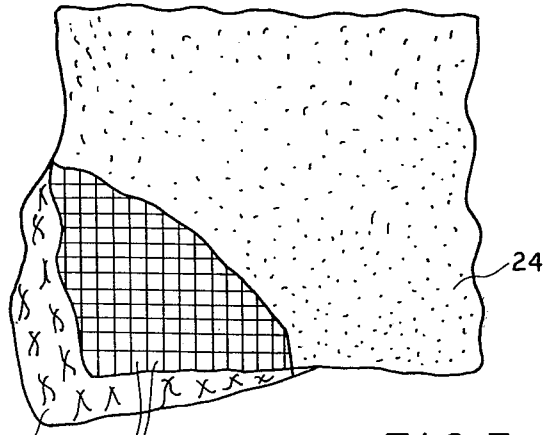
FIG. 3 is a plan view partly broken away illustrating the flooring.
Figure 2:
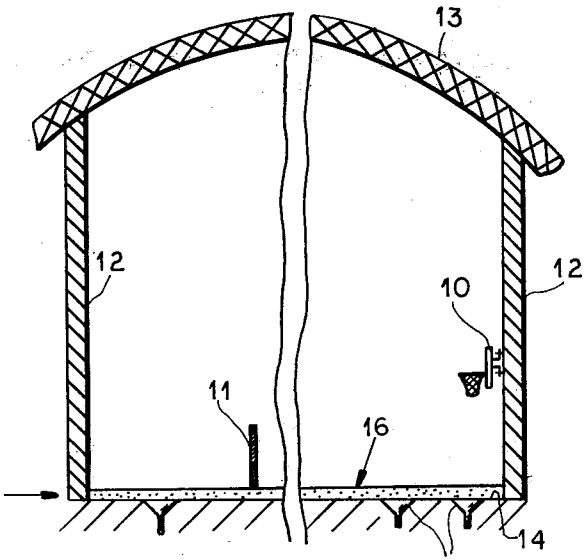
FIG. 2 is a diagrammatic section through a sports arena provided with the flooring composition of FIG. 1.

FIG. 2 illustrates an indoor sports arena with a basketball facility 10, a tennis net 11 and the usual walls 12 and roof structure 13. The subsurface of cast concrete is shown at 14 and can be provided with spaced-apart drains 15 of any conventional design. The composite flooring shown in FIG. 1 is here represented at 16 and extends from wall to wall over the entire bottom of the indoor arena. FIG. 3 illustrates the use of a rectangular mesh fabric of elastomeric material, e.g. rubber threads 23 as a resilient layer into and ontpo which the cinders or other outdoor composition may be packed as shown at 24. The rubber strands 23 may be interwoven with metal strands to form part of a metal/elastomeric screen. The subsurface is here represented at 22.

Figure 4:
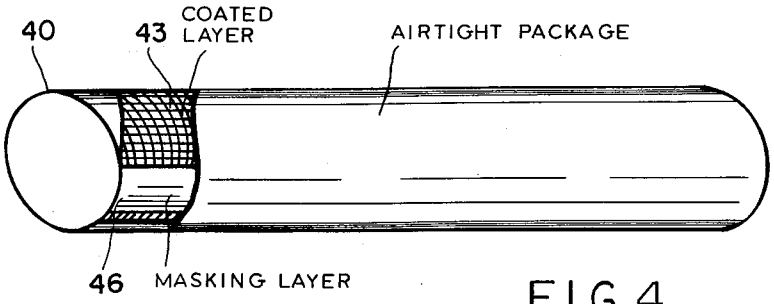
FIG. 4 is a diagram of a package for the retention layer of the present invention facilitating use of the principles of the invention.

FIG. 4 shows a hermetically sealed container for the web. The container 40 encloses the coiled web 43 which has been previously coated with the adhesive, e.g. air-curing polyurethane, the layer 46 being applied to the coated surface to enable it to be unrolled and applied to the subsurface.

I claim:

1. A floor covering for an indoor sports arena having a massive subflooring, comprising a support and retention open work layer applied to said subflooring, and a packed outdoor surfacing composition deposited in and on said layer, wherein said layer comprises a coconut fiber mat as an elastic material having a reticulate structure, having interstices of dimensions substantially matching the particle size of said composition, and is bonded to said subflooring and wherein said composition is selected from the group which consists of sand, red sand, cinders and dirt.

2. A floor covering for an indoor sports arena having a massive subflooring, comprising a support and retention open work layer applied to said subflooring, and a packed outdoor surfacing composition deposited in and on said layer, wherein said layer comprises a synthetic resin filament web as an elastic material having a reticulate structure, having interstices of dimensions substantially matching the particle size of said composition, and is bonded to said subflooring and wherein said composition is selected from the group which consists of sand, red sand, cinders and dirt.

3. A floor covering for an indoor sports arena having a massive subflooring, comprising a support and retention open work layer applied to said subflooring, and a packed outdoor surfacing composition deposited in and on said layer, wherein said layer comprises a metal mesh as an elastic material having a reticulate structure, having interstices of dimensions substantially matching the particle size of said composition, and is bonded to said subflooring and wherein said composition is selected from the group which consists of sand, red sand, cinders and dirt.

4. The floor covering defined in claim 1, claim 2 or claim 3 wherein said layer is bonded with an elastic adhesive to said subsurface.

5. A method of applying a floor to a subflooring of an indoor sports arena which comprises the steps of:

(a) coating an elastic open work layer with an elastic air-activation adhesive, wherein said layer comprises a coconut fiber mat, a synthetic resin filament web or a metal mish as an elastic material having a reticulate structure and having interstices of dimensions substantially matching the particle size of said composition;

(b) coiling said layer upon the coating thereof with said adhesive for storing same in an air-tight package;

(c) at said arena, removing said layer from said package and applying said layer to said subfloor;

(d) applying an outdoor sports-surface composition to the layer applied to said subfloor, wherein said composition is selected from the group which consists of sand, red sand, cinders and dirt; and (e) packing said composition into and onto said layer on said subfloor.

* * * * *